US008103204B2

(12) United States Patent
Takahashi

(10) Patent No.: US 8,103,204 B2
(45) Date of Patent: Jan. 24, 2012

(54) FIXING APPARATUS AND IMAGE FORMATION APPARATUS

(75) Inventor: Koji Takahashi, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 137 days.

(21) Appl. No.: 12/724,530

(22) Filed: Mar. 16, 2010

(65) Prior Publication Data

US 2010/0239338 A1 Sep. 23, 2010

(30) Foreign Application Priority Data

Mar. 19, 2009 (JP) ..... 2009-067595

(51) Int. Cl.
*G03G 15/20* (2006.01)

(52) U.S. Cl. ..... 399/333; 399/329

(58) Field of Classification Search ..... 399/328, 399/329, 330, 331, 333
See application file for complete search history.

(56) References Cited

U.S. PATENT DOCUMENTS

| | | | | |
|---|---|---|---|---|
| 5,765,085 | A * | 6/1998 | Law et al. | 399/329 |
| 6,002,106 | A | 12/1999 | Kataoka et al. | |
| 7,593,681 | B2 * | 9/2009 | Tamemasa et al. | 399/333 |
| 7,668,496 | B2 * | 2/2010 | Tamemasa et al. | 399/329 |
| 7,764,915 | B2 * | 7/2010 | Uehara et al. | 399/333 |

FOREIGN PATENT DOCUMENTS

| | | |
|---|---|---|
| JP | 07-281545 | 10/1995 |
| JP | 10-186920 | 7/1998 |
| JP | 2003-76190 A | 3/2003 |
| JP | 2004-281123 | 10/2004 |
| JP | 2005-55786 A | 3/2005 |
| JP | 2006-221041 | 8/2006 |

OTHER PUBLICATIONS

Office Action (Notification of Reasons for Refusal) dated Jan. 5, 2011, issued in the corresponding Japanese Patent Application No. 2009-067595, and an English Translation thereof.

* cited by examiner

*Primary Examiner* — Hoang Ngo
(74) *Attorney, Agent, or Firm* — Buchanan Ingersoll & Rooney PC

(57) ABSTRACT

In a fixing apparatus including a fixing roller including an elastic layer, a heating roller including a heat source, the heating roller being formed by sequentially layering an elastic layer and a mold release layer on an outer circumferential face of a shaft, a fixing belt wound around the fixing roller and the heating roller, the fixing belt being formed by sequentially layering an elastic layer and a mold release layer on an endless belt type base material layer formed from heat-resistant resin, and a pressurizing roller that is pressed to the fixing roller via the fixing belt, volume resistivity of the base material layer of the fixing belt is in a range of $10^{10}$ Ωcm to $10^{17}$ Ωcm inclusive, volume resistivity of the elastic layer of the fixing belt is in a range of $10^{12}$ Ωcm to $10^{16}$ Ωcm inclusive, volume resistivity of the elastic layer of the fixing roller is in a range of $10^{12}$ Ωcm to $10^{16}$ Ωcm inclusive, and volume resistivity of the elastic layer of the pressurizing roller is in a range of $10^{3}$ Ωcm to $10^{8}$ Ωcm inclusive.

4 Claims, 7 Drawing Sheets

| Fixing belt 202 | |
|---|---|
| Base material layer | $10^{10}$ Ωcm |
| Elastic layer | $10^{12}$ Ωcm |
| Mold release layer | $10^{15}$ Ωcm |

| Fixing roller 201 | |
|---|---|
| Elastic layer | $10^{12}$ Ωcm |

| Pressurizing roller 209 | |
|---|---|
| Mold release layer | $10^{15}$ Ωcm |
| Elastic layer | $10^{8}$ Ωcm |

FIG.3

| Fixing belt 202 | |
|---|---|
| Base material layer | $10^{10}\ \Omega\,cm$ |
| Elastic layer | $10^{12}\ \Omega\,cm$ |
| Mold release layer | $10^{15}\ \Omega\,cm$ |

| Fixing roller 201 | |
|---|---|
| Elastic layer | $10^{12}\ \Omega\,cm$ |

| Pressurizing roller 209 | |
|---|---|
| Mold release layer | $10^{15}\ \Omega\,cm$ |
| Elastic layer | $10^{8}\ \Omega\,cm$ |

FIG.4

| Fixing belt | | Fixing roller | Pressurizing roller | Charge potential on heating side | Charge potential on pressurizing side | Difference of potential | Electrostatic offset | Separating discharge |
|---|---|---|---|---|---|---|---|---|
| Base material layer | Elastic layer | Elastic layer | Elastic layer | | | | | |
| $10^{8}\Omega$cm | $10^{10}\Omega$cm | $10^{13}\Omega$cm | $10^{10}\Omega$cm | −100V | −1500V | −1400V | Poor | Poor |
| $10^{8}\Omega$cm | $10^{10}\Omega$cm | $10^{13}\Omega$cm | $10^{7}\Omega$cm | −100V | 100V | 200V | Good | Fair |
| $10^{8}\Omega$cm | $10^{10}\Omega$cm | $10^{10}\Omega$cm | $10^{10}\Omega$cm | 0V | −1200V | −1200V | Poor | Poor |
| $10^{8}\Omega$cm | $10^{10}\Omega$cm | $10^{10}\Omega$cm | $10^{7}\Omega$cm | 0V | 150V | 150V | Good | Fair |
| $10^{8}\Omega$cm | $10^{13}\Omega$cm | $10^{13}\Omega$cm | $10^{10}\Omega$cm | −300V | −2000V | −1700V | Poor | Poor |
| $10^{8}\Omega$cm | $10^{13}\Omega$cm | $10^{13}\Omega$cm | $10^{7}\Omega$cm | −300V | −250V | 50V | Good | Poor |
| $10^{8}\Omega$cm | $10^{13}\Omega$cm | $10^{10}\Omega$cm | $10^{10}\Omega$cm | −250V | −2000V | −1750V | Poor | Poor |
| $10^{8}\Omega$cm | $10^{13}\Omega$cm | $10^{10}\Omega$cm | $10^{7}\Omega$cm | −250V | −300V | 50V | Good | Poor |
| $10^{10}\Omega$cm | $10^{10}\Omega$cm | $10^{13}\Omega$cm | $10^{10}\Omega$cm | −300V | −2000V | −1700V | Poor | Poor |
| $10^{10}\Omega$cm | $10^{10}\Omega$cm | $10^{13}\Omega$cm | $10^{7}\Omega$cm | −300V | −350V | −50V | Good | Poor |
| $10^{10}\Omega$cm | $10^{10}\Omega$cm | $10^{10}\Omega$cm | $10^{10}\Omega$cm | −200V | −2000V | −1800V | Poor | Poor |
| $10^{10}\Omega$cm | $10^{10}\Omega$cm | $10^{10}\Omega$cm | $10^{7}\Omega$cm | −200V | −250V | −50V | Good | Poor |
| $10^{10}\Omega$cm | $10^{13}\Omega$cm | $10^{13}\Omega$cm | $10^{10}\Omega$cm | −2000V | −2000V | 0V | Good | Poor |
| $10^{10}\Omega$cm | $10^{13}\Omega$cm | $10^{13}\Omega$cm | $10^{7}\Omega$cm | −2000V | −100V | 1900V | Good | Good |
| $10^{10}\Omega$cm | $10^{13}\Omega$cm | $10^{10}\Omega$cm | $10^{10}\Omega$cm | −700V | −2000V | −1300V | Good | Poor |
| $10^{10}\Omega$cm | $10^{13}\Omega$cm | $10^{10}\Omega$cm | $10^{7}\Omega$cm | −700V | −350V | 350V | Good | Fair |

FIXING APPARATUS AND IMAGE FORMATION APPARATUS

This application is based on an application No. 2009-067595 filed in Japan, the content of which is hereby incorporated by reference.

BACKGROUND OF INVENTION

1. Field of the Invention

The present invention relates to a fixing apparatus and an image formation apparatus, and in particular to technology for preventing deterioration of image quality in a fixing apparatus.

2. Related Art

An electrophotographic-type image formation apparatus, after causing toner to be electrostatically adsorbed to a charged recording sheet, causes the toner to be fused to the recording sheet by a fixer. To fix the toner, in order to pass the recording sheet through a heating roller and a pressurizing roller, the heating roller is charged by the charged recording sheet.

As a result, there are cases in which image quality deteriorates due to electrostatic offset of the toner on the recording sheet being electrostatically adsorbed to the heating roller, or discharge occurring when the recording sheet is ejected from the fixer (hereinafter, such image quality deterioration is referred to as "sheet back end separation discharge noise").

Measures against this type of problem include, for example, impressing a bias voltage on the heating roller, pressing an electrically conductive material to the heating roller and neutralizing the heating roller, or pressing an electrically conductive material to the recording sheet to which toner has been transferred and neutralizing the recording sheet (for example, see Japanese Patent Application Publication No. 2005-55786). By doing this, the charge of the heating roller can be lessened, and the occurrence of electrostatic offset can be suppressed.

However, demand for miniaturization and reduced cost of image formation apparatuses continues to increase, and it must be noted that providing material for neutralizing the heating roller or the recording sheet and material for impressing a bias voltage on the heating roller, as in conventional technology, are contrary to such demands.

Also, since the heating roller rotates at the time of image formation, and the recording sheet, needless to say, moves along a conveyance path, a strong frictional force operates on the neutralizing materials in contact with the heating roller and the recording sheet. Also, the same is true for the materials for impressing a voltage on the heating roller. For this reason, such materials unavoidably deteriorate with the passage of time, leading to deterioration of image quality with the passage of time.

Furthermore, technical difficulties caused by high temperature occur when impressing voltage on the heating roller.

SUMMARY OF INVENTION

The present invention has been achieved in view of the above problem, and an aim thereof is to provide a fixing apparatus and an image formation apparatus that prevent electrostatic offset and sheet back end separation discharge noise without leading to addition of parts or added cost, and furthermore without causing shortening of the life of the apparatus.

In order to achieve the above aim, the fixing apparatus pertaining to the present invention fuses a toner image to a recording sheet, and includes a fixing roller including an elastic layer, a heating roller including a heat source, the heating roller being formed by sequentially layering an elastic layer and a mold release layer on an outer circumferential face of a shaft, a fixing belt wound around the fixing roller and the heating roller, the fixing belt being formed by sequentially layering an elastic layer and a mold release layer on an endless belt type base material layer formed from heat-resistant resin, and a pressurizing roller that is pressed to the fixing roller via the fixing belt, volume resistivity of the base material layer of the fixing belt being in a range of $10^{10}$ Ωcm to $10^{17}$ Ωcm inclusive, volume resistivity of the elastic layer of the fixing belt being in a range of $10^{12}$ Ωcm to $10^{16}$ Ωcm inclusive, volume resistivity of the elastic layer of the fixing roller being in a range of $10^{12}$ Ωcm to $10^{16}$ Ωcm inclusive, and volume resistivity of the elastic layer of the pressurizing roller being in a range of $10^{3}$ Ωcm to $10^{8}$ Ωcm inclusive.

According to this structure, since the difference of potential between the fixing belt and the pressurizing roller is greater than or equal to 1500 V, electrostatic offset and sheet back end separation discharge noise can be eliminated.

In this case, it is preferable for a total of a thickness of the fixing belt and a thickness of the elastic layer of the fixing roller to be in a range of 4 mm to 8 mm inclusive, and if the base material layer of the fixing belt is formed from polyimide, this structure enables improving the longevity of the fixing belt, and also facilitates adjusting the volume resistivity of the base material layer.

The image formation apparatus of the present invention includes the fixing apparatus of the present invention. This structure enables eliminating electrostatic offset and sheet back end separation discharge noise.

BRIEF DESCRIPTION OF THE DRAWINGS

These and other objects, advantages, and features of the invention will become apparent from the following description thereof taken in conjunction with the accompanying drawings, which illustrate specific embodiments of the present invention.

In the drawings:

FIG. 3 shows electrical properties (volume resistivity) of a fixing belt 202, a fixing roller 201, and a pressurizing roller 209;

FIG. 4 shows experiment conditions and results of an experiment to determine a preferable range of volume resistivity for each part of the fixing apparatus 100;

DESCRIPTION OF PREFERRED EMBODIMENT

An embodiment of the present invention is described below with reference to the drawings.

[1] Structure of the Image Formation Apparatus

First, the following describes the structure of the image formation apparatus pertaining to the present embodiment.

Figure 1:
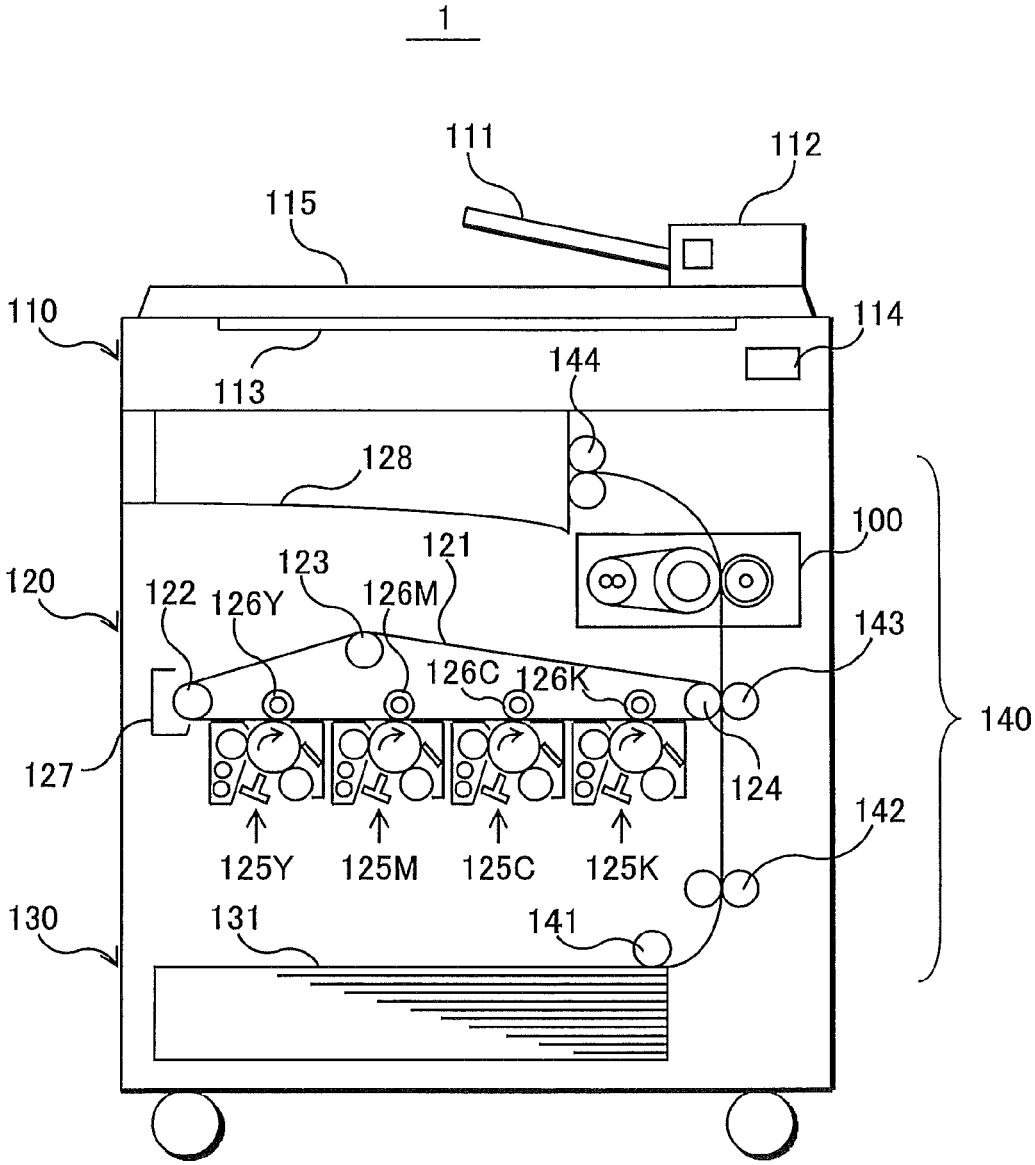
FIG. 1 shows a main structure of an image formation apparatus pertaining to the present invention.

FIG. 1 shows a main structure of the image formation apparatus pertaining to the present embodiment. As shown in FIG. 1, the image formation apparatus 1 is a tandem method color image formation apparatus, and includes a fixing apparatus 100, an image reader 110, an image formation section 120, a paper storage section 130, and a paper transporter 140.

The image reader 110 includes a loading platform 111, a transport section 112, an original glass plate 113, a scanner 114, and an ejection platform 115. According to directions from a user, the image reader 110 obtains an original, one sheet at a time, via the transport section 112, and transports the original to the top of the original glass plate 113.

The original on top of the original glass plate 113 is read by the scanner 114, and ejected to the top of the ejection platform 115. The scanner 114 includes a three-row CCD (Charge Coupled Device) line sensor corresponding to the three primary colors. The scanner 114 reads the original and generates image data in each color.

Note that the scanner 114 may use a sheet-through method, in which the original is read by passing sheets through while the CCD line sensor is still. Also, image data may be generated by exposing the original loaded on the original glass plate 113 with use of an exposure lamp and reflective mirrors that are moving in parallel with the original glass plate 113, and guiding the reflected light to the CCD line sensor via the plurality of reflective mirrors.

The image formation section 120 includes an intermediate transfer belt 121, a driven roller 122, a tension roller 123, a drive roller 124, image creation sections 125Y to 125K, primary transfer rollers 126Y to 126K, a cleaning apparatus 127, a fixer 128, and a catch tray 129.

The intermediate transfer belt 121 is suspended over the driven roller 122, the tension roller 123, and the drive roller 124. The image creation sections 125Y to 125K are arranged in a row along the intermediate transfer belt 121 in the order of yellow (Y), magenta (M), cyan (C), and black (K). The image creation sections 125Y to 125K create a toner image in each of the colors YMCK based on the image data generated by the scanner 114.

The toner images created by the image creation sections 125Y to 125K are electrostatically transferred by the primary transfer rollers 126Y to 126K respectively at appropriate timings, so that the toner images are superimposed on the intermediate transfer belt 121. Accordingly, a color image is formed.

The paper storage section 130 includes a paper feed cassette 131. A recording sheet is stored in the paper feed cassette 131. Note that the paper storage section 130 may include a plurality of paper feed cassettes for recording sheets of different sizes, and may be configured to feed a recording sheet of a size specified by a user.

The paper transporter 140 includes a pick-up roller 141, a timing roller 142, a secondary transfer roller 143, and an ejection roller 144. The pick-up roller 141 obtains the recording sheets stored in the paper feed cassette 131 one at a time. The obtained recording sheets are then conveyed by the timing roller 142.

The secondary transfer roller 143 electrostatically transfers the toner image on the intermediate transfer belt 121 to the recording sheet. Thereafter, the residual toner on the intermediate transfer belt 121 is collected and disposed of by the cleaning apparatus 127.

The fixing apparatus 100 heats the toner image on the recording sheet, and fuses the toner image to the recording sheet. The ejection roller 144 ejects the recording sheet having the toner image fixed thereon to the catch tray 129.

[2] Structure of Fixing Apparatus 100

The following describes the structure of the fixing apparatus 100.

Figure 2:
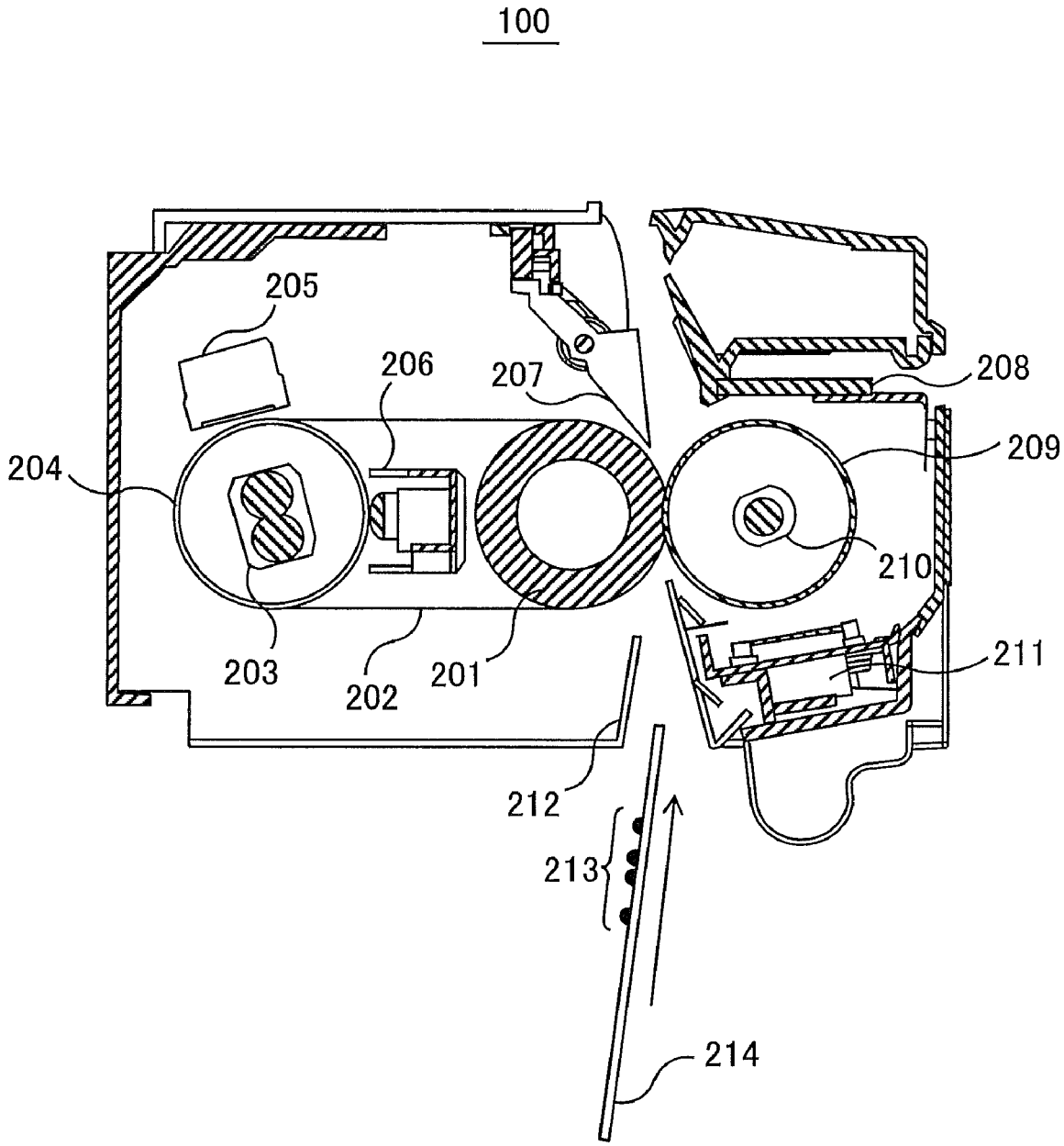
FIG. 2 shows a main structure of a fixing apparatus 100.

FIG. 2 shows a main structure of the fixing apparatus 100. As shown in FIG. 2, the fixing apparatus 100 includes a fixing roller 201, a fixing belt 202, heaters 203 and 210, a heating roller 204, thermostats 205 and 211, thermistors 206 and 208, a separating finger 207, a pressurizing roller 209, and an entry guide 212.

An elastic layer is formed on an upper face of an outer circumference of an iron shaft of the fixing roller 201. The iron shaft has an outer diameter of 18 mm. Also, on the elastic layer, a silicone sponge layer having a thickness of 2 mm is formed, and thereon a silicone rubber layer having a thickness of 4 mm is formed. The outer diameter of the entire fixing roller 201 is 30 mm. Note that the reason for forming the silicone rubber layer with a thickness of 4 mm is to lower electrostatic capacity and raise charged voltage while ensuring a necessary fixing nip width.

The upper outer circumference surface of an aluminum shaft of the heating roller 204 is covered with polytetrafluoroethylene (PTFE). The aluminum shaft is a cylindrical shape having a thickness of 0.5 mm, and the heating roller 204 has an outer diameter of 30 mm.

The heater 203 is a halogen lamp, and is disposed in an inner part of the heating roller 204. The output of the heater 203 is 1000 watts. The state of conducting to the heater 203 is controlled by the thermostat 205. Also, the thermistor 206 measures the temperature of the outer circumference surface of the heating roller 204.

The fixing belt 202 is an endless belt, is suspended across the fixing roller 201 and the heating roller 204, and is driven to rotate along with the rotation of the fixing roller 201. An elastic layer and a mold release layer are sequentially formed on a base material layer made of polyimide on the fixing belt 202. When removed from the fixing roller 201 and the heating roller 204, in the cylindrical state, the outer diameter of the fixing belt 202 is 65 mm.

The thickness of the base material layer is 70 μm. The elastic layer is made of silicone rubber, and has a thickness of 150 μm. Also, the mold release layer is covered by fluorine resin, and has a thickness of 20 μm. Note that using polyimide as the material of the base material layer not only enables realizing superior heat resistance, flexibility and resistance to wear, but also facilitates adjusting volume resistivity. As described later, the present invention solves the technical problem by adjusting the volume resistivity.

The pressurizing roller 209 is formed by sequentially layering an elastic layer and a mold release layer on an outer circumferential layer of an aluminum shaft. The aluminum shaft has a cylindrical shape with a thickness of 2 mm. The elastic layer is made of silicone rubber, and has a thickness of 1.5 mm. Also, the mold release layer is made of perfluoroalkoxy tubing, and has a thickness of 30 μm. The pressurizing roller 209 has an outer diameter of 30 mm.

The pressurizing roller 209 forms a fixing nip by pressed contact with the fixing roller 201 via the fixing belt 202. In the fixing nip portion, the nip load is between 50 N and 450 N inclusive, the nip width is approximately 8 mm, and the length is approximately 320 mm.

The heater 210 is also a halogen lamp, and is disposed in the pressurizing roller 209. The output of the heater 210 is 230 watts. The state of conducting electricity to the heater 210 is controlled by the thermostat 211.

According to the above structure, the recording sheet 214 supporting unfixed toner 213 is guided by the entry guide 212 toward the fixing nip formed by the fixing roller 201 and the pressurizing roller 209, and after the unfixed toner 213 is fused thereto by the fixing nip portion, the recording sheet 214 is separated from the fixing roller 201 by the separating finger 207, and is ejected out of the fixing apparatus 100.

[3] Electrical Properties of Fixing Apparatus Parts

The fixing apparatus pertaining to the present invention is characterized by electrical properties of several parts.

FIG. 3 is a chart showing electrical properties (volume resistivity) of the fixing belt 202, the fixing roller 201, and the pressurizing roller 209.

In order to support negatively charged toner, the recording sheet is positively charged before passing through the secondary transfer roller. The recording sheet is neutralized after the secondary transfer. Since the efficiency of the neutralization depends on environmental conditions such as temperature and humidity, there are cases in which the recording sheet is charged to some extent when passing through the fixing apparatus.

To pass a positively-charged fixing sheet through the fixing apparatus, the fixing belt 202 and the pressurization roller 209 are polarized, and these surfaces are negatively charged. This causes electrostatic offset and separation discharge.

In contrast, by using volume resistivity as described above, the fixing belt 202 becomes more readily polarized for passing the positively charged recording sheet than the pressurizing roller 209. For this reason, a relationship between the potential Vh and the potential Vp of the pressurizing roller 209 is such that $$Vh<Vp.$$

Therefore, since the unfixed toner supported by the recording sheet is electrostatically adsorbed toward the pressurizing roller 209 and receives electrostatic repulsion force from the fixing belt 202, electrostatic offset is prevented.

Also, the present embodiment enables reliably preventing separating discharge and realizing high-quality images, since according to the present invention, the difference of potential between the pressurizing roller 209 and the fixing belt 202 can be made approximately 1900 V, and if the difference of potential is greater than or equal to 1500 V, separation discharge can be prevented.

[4] Range of Volume Resistivity

An experiment has been performed for determining a preferable range of volume resistivity, so the results of this experiment are described next.

FIG. 4 shows the experiment conditions and corresponding results. As shown in FIG. 4, the volume resistivity of the base material layer of the fixing belt 202 is set as one of $10^8$ Ωcm or $10^{10}$ Ωcm, and the volume resistivity of the elastic layer is set as one of $10^{10}$ Ωcm or $10^{13}$ Ωcm. Also, the elastic layer of the fixing roller 201 is set as one of $10^{10}$ Ωcm or $10^{13}$ Ωcm, and the elastic layer of the pressurizing roller 209 is set as one of $10^7$ Ωcm or $10^{10}$ Ωcm. Note that the volume resistivity has a measurement deviation of ±1 digit.

Circumstances of occurrence of electrostatic offset and sheet back end separation discharge noise were investigated under these conditions.

Figure 5:
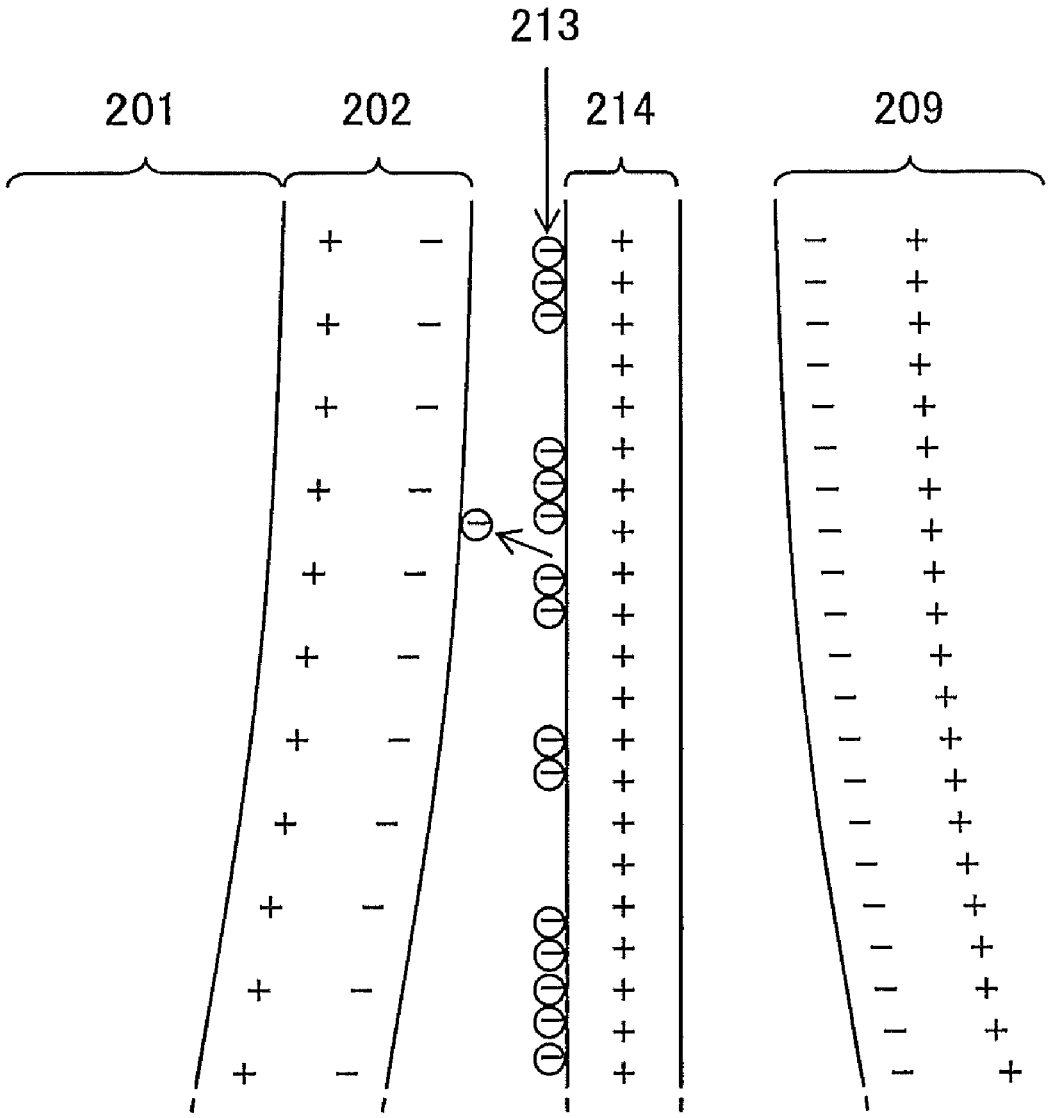
FIG. 5 illustrates a mechanism by which electrostatic offset occurs.

FIG. 5 illustrates a mechanism by which electrostatic offset occurs. As shown in FIG. 5, the recording sheet 214 for supporting the negatively charged toner 213 is positively charged. When this positively charged recording sheet 214 passes between the fixing belt 202 and the pressurizing roller 209, the fixing belt 202 and the pressurizing roller 209 are respectively polarized by the charged voltage of the recording sheet 214, and the surfaces thereof are negatively charged (as expressed by the "–" sign in FIG. 5).

In this case, when the pressurizing roller 209 has a lower surface potential than the fixing belt 202 (expressed in FIG. 5 by the number of "–" signs), the toner 213 on the recording sheet 214 may be electrostatically adsorbed due to the surface potential of the fixing belt 202, or adsorbed to the fixing belt 202 due to the surface potential of the pressurizing roller 209 or electrostatic repulsion.

Accordingly, electrostatic offset (pinholes) occur. Contrarily, when the surface voltage of the fixing belt 202 is lower than that of the pressurizing roller 209, the toner 213 receives electrostatic power towards the pressurizing roller side, but since this is obstructed by the recording sheet 214, electrostatic offset does not occur.

Due to this fact, if the efficiency of polarization of the fixing belt 202 and the pressurization roller 209 is adjusted by adjusting the volume resistivity, it is expected that the occurrence of electrostatic offset can be prevented by lowering the surface potential of the fixing belt 202 and raising the surface potential of the pressurizing roller 209.

Figure 6A:
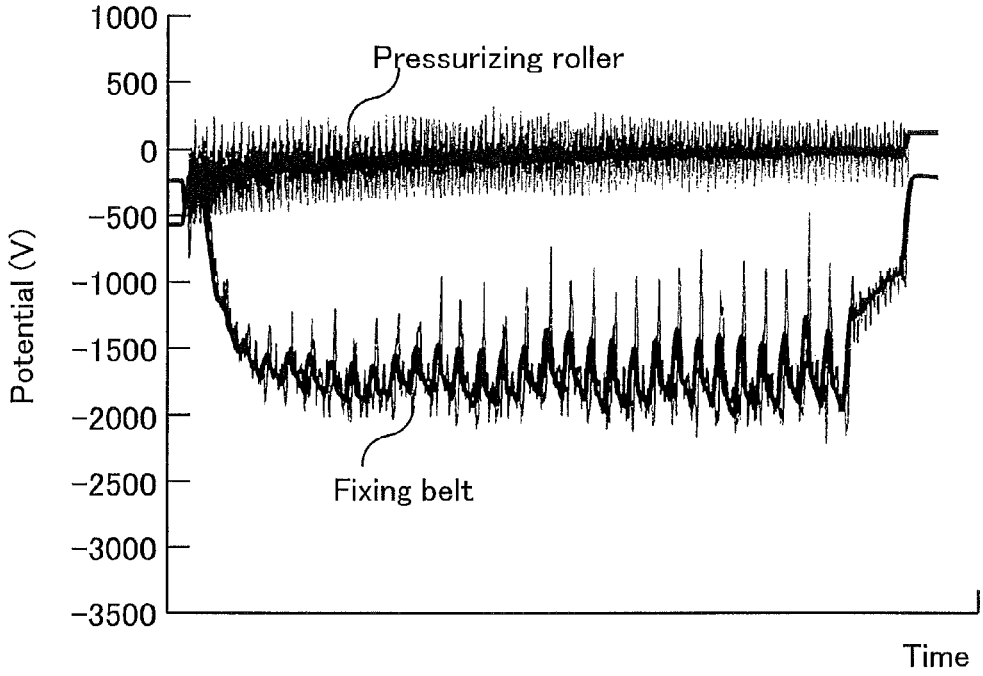
FIG. 6 is a graph showing transitions of surface potentials between the fixing belt 202 and the pressurizing roller 209 at the time of image formation, FIG. 6A pertaining to the image formation apparatus of the present embodiment, and FIG. 6B pertaining to an image formation apparatus pertaining to conventional technology.
Figure 6B:
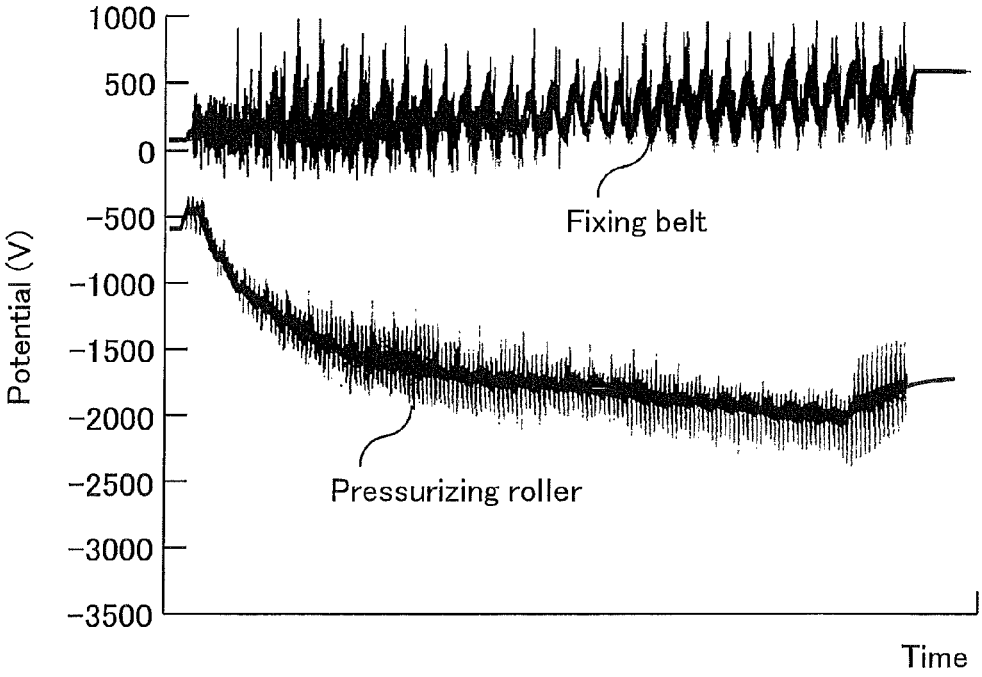

FIG. 6 is a graph showing transitions of surface potentials between the fixing belt and the pressurizing roller 209 at the time of image formation, FIG. 6A pertaining to the image formation apparatus of the present embodiment, and FIG. 6B pertaining to the image formation apparatus pertaining to conventional technology.

The image formation apparatus pertaining to conventional technology also includes a fixing belt and a pressurizing roller. The fixing belt is formed by sequentially layering a 200 μm-thick elastic layer made of silicone rubber and a 30 μm-thick mold release layer made of PFA tube on a 35 μm-thick base material layer made of nickel.

Also, the pressurizing roller pertaining to conventional technology is formed by sequentially layering a 2.5 μm-thick elastic layer made of silicone rubber and a 30 μm-thick mold release layer made of PFA tube on an outer circumferential face of a 2.5 μm-thick shaft layer made of STKM 12 layer made of nickel. The base material layer of the fixing belt and the shaft layer of the pressurizing roller are formed from an electrically conductive material, and the other parts are made from an insulating material.

As shown in FIG. 6A, in the image formation apparatus pertaining to the present embodiment, when the positively charged sheet passes through at the time of image formation, the surface potential of the pressurizing roller is higher than that of the fixing belt. Accordingly, electrostatic offset does not occur. Meanwhile, as shown in FIG. 6B, in the image formation apparatus pertaining to conventional technology, since the surface potential of the fixing belt is higher than that of the pressurizing roller, toner is adsorbed to the fixing belt, and electrostatic offset occurs.

Figure 7A:
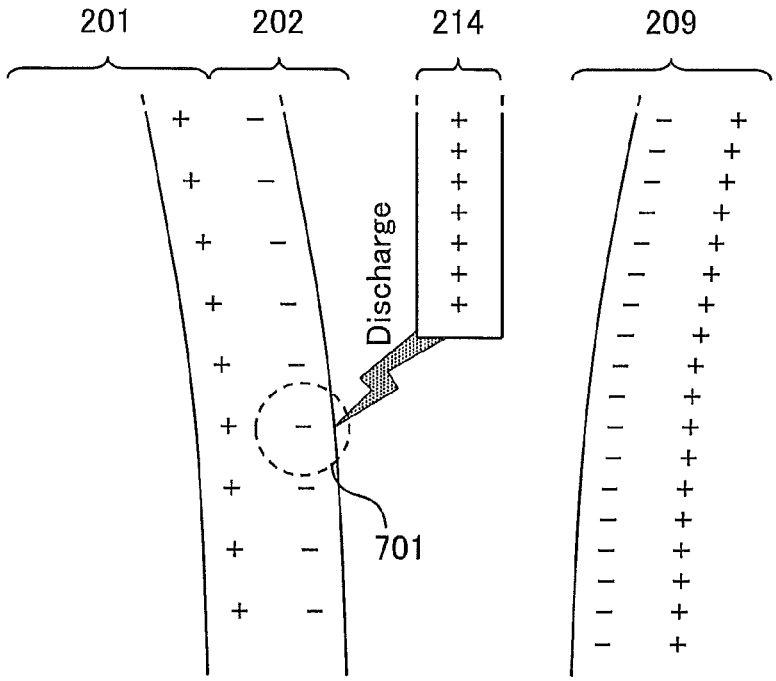
FIG. 7 illustrates a mechanism by which sheet back end separation discharge noise occurs, FIG. 7A showing how a back end of a recording sheet separates from the fixing belt 202 and the pressurizing roller 209, and FIG. 7B showing how the next recording sheet passes through the fixing belt 202 and the pressurizing roller 209.
Figure 7B:
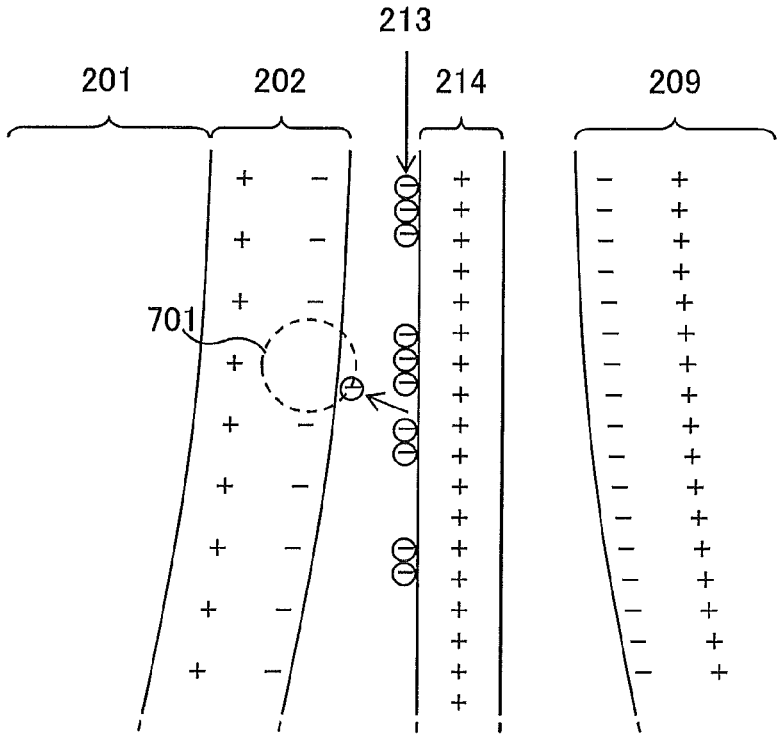

FIG. 7 illustrates a mechanism by which sheet back end separation discharge noise occurs, FIG. 7A showing how the back end of the recording sheet separates from the fixing belt 202 and the pressurizing roller 209, and FIG. 7B showing how the next recording sheet passes through the fixing belt 202 and the pressurizing roller 209.

As described above, since the recording sheet 214 is positively charged and the surfaces of the fixing belt 202 and pressurizing roller 209 are negatively charged, mutual attraction occurs therebetween due to electrostatic attraction. For this reason, when pressure is applied to the recording sheet 214 thereby separating the recording sheet 214 from the fixing belt 202 and the pressurizing roller 209, there are cases in which discharge occurs between the recording sheet 214 and the fixing belt 202 or the pressurizing roller 209.

FIG. 7A shows a case when discharge has occurred between the recording sheet 214 and the fixing belt 202. When discharge occurs between an area 701 of the fixing belt 202, enclosed by a dashed-line circle in the drawing, and the fixing sheet 214, the charge of the circled area 701 is neutralized and enters an uncharged state.

In this state, the fixing belt 202 is driven to rotate, and when the recording sheet 214 thereafter opposes the circled area 701 (FIG. 7B), since electrostatic repulsion does not occur between the circled area 701 and the toner 213, the toner 213 is adsorbed to the circled area 701 from the recording sheet 214. In this way, sheet back end separation discharge noise occurs.

This problem also is thought to be eliminated more easily, when giving a negative charge to the toner 213, the higher the electrostatic repulsion between the fixing belt 202 and the toner 213 is as a result of giving the fixing belt 202 a larger negative charge.

In view of this, a volume resistivity that can eliminate all of the problems has been determined based on circumstances of occurring electrostatic offset and sheet back end separation discharge noise occurrence. In FIG. 4, the word "Poor" indicates circumstances of electrostatic offset occurring, and this is when electrostatic noise has clearly been seen. Meanwhile, the word "Good" indicates that electrostatic noise has not been seen.

Also, the word "Poor" that indicates a circumstance of sheet back end separation discharge noise occurring indicates that when image formation is repeated the sheet back end separation discharge noise increases gradually, and several lines of noise appear. Also, "Fair" indicates that there is only one noise line, and the amount of noise stops at a degree of being recognizable when looking carefully at a half-tone image. "Good" indicates that sheet back end separation discharge noise is not seen.

From a standpoint of practical necessity, "Poor" indicates that noise is seen in many images, and is a level of image quality that is not allowable by any category of copier or printer. "Fair" indicates that noise is difficult to see in normal text and images, but since noise is seen in half-tone portions such as a blue sky in a photographic image, "Fair" is a level of image quality not allowable by high-end printers or copiers, and copiers and printers that frequently print high-quality photographic images. "Good" indicates a level at which there are no problems in any category.

As shown in FIG. 4, when the volume resistivity is $10^{10}$ Ωcm on the base material layer of the fixing belt 202, $10^{13}$ Ωcm on the elastic layer, $10^{13}$ Ωcm on the elastic layer of the fixing roller 201, and $10^{7}$ ωcm on the elastic layer of the pressurizing roller 209, both electrostatic offset and sheet back end separation discharge noise are eliminated.

In such a case, the difference of potential between the fixing belt 202 and the pressurizing roller 209 is 1900 V, and according to an executed experiment not described here, it has been shown that if the difference of potential is greater than or equal to 1500 V, both problems can be solved.

Furthermore, with consideration to the measurement deviation of volume resistivity, it has been shown that by setting the volume resistivity as shown below, the difference of potential between the fixing belt 202 and the pressurizing roller 209 can be made greater than or equal to 1500 V, thus overcoming both the electrostatic offset and the sheet back end separation discharge noise:

(a) Greater than or equal to $10^{10}$ Ωcm at the base material of the fixing belt 202

(b) Greater than or equal to $10^{12}$ Ωcm at the elastic layer of the fixing belt 202

(c) Greater than or equal to $10^{12}$ Ωcm at the elastic layer of the fixing roller (d) Less than or equal to $10^{7}$ Ωcm at the elastic layer of the pressurizing roller 209.

[5] Variations

Although the present invention has been described based on the embodiment, of course the present invention is not limited to the above embodiment, and the following variations are possible.

(1) Although not specifically mentioned in the above embodiment, when the total of the thickness of the fixing belt and the thickness of the elastic layer of the fixing roller is small, since the shaft of the fixing roller is made of metal, there is a risk of influencing the charged potential of the fixing belt. For this reason, it is preferable for the total to be greater than or equal to 4 mm.

Also, from a practical standpoint, particularly considering the demand for miniaturization of the fixing apparatus, the total is preferably equal to or less than 8 mm.

(2) Although not specifically mentioned in the above embodiment, the upper limit of the volume resistivity of the base material layer of the fixing belt 202 is $10^{17}$ Ωcm. The reason is that this is the maximum value of volume resistivity of a polyimide, and a higher volume resistivity than this cannot be obtained.

Also, the upper limit of the volume resistivity of the elastic layer of the fixing belt 202 is $10^{16}$ Ωcm. The reason is that this is the maximum value of volume resistivity of silicone rubber. Similarly, the upper limit of the volume resistivity of the elastic layer of the fixing roller 201 is $10^{16}$ Ωcm.

The lower limit of the volume resistivity of the elastic layer of the pressurizing roller 209 is $10^{3}$ Ωcm. The reason is that this is the minimum volume resistivity of silicone rubber, and a lower volume resistivity than this cannot be obtained.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing apparatus for fusing a toner image to a recording sheet, comprising:

a fixing roller including an elastic layer;

a heating roller including a heat source, the heating roller being formed by sequentially layering an elastic layer and a mold release layer on an outer circumferential face of a shaft;

a fixing belt wound around the fixing roller and the heating roller, the fixing belt being formed by sequentially layering an elastic layer and a mold release layer on an endless belt type base material layer formed from heat-resistant resin; and a pressurizing roller that is pressed to the fixing roller via the fixing belt, wherein volume resistivity of the base material layer of the fixing belt is in a range of $10^{10}$ Ωcm to $10^{17}$ Ωcm inclusive, volume resistivity of the elastic layer of the fixing belt is in a range of $10^{12}$ Ωcm to $10^{16}$ Ωcm inclusive, volume resistivity of the elastic layer of the fixing roller is in a range of $10^{12}$ Ωcm to $10^{16}$ Ωcm inclusive, and volume resistivity of the elastic layer of the pressurizing roller is in a range of $10^3$ Ωcm to $10^8$ Ωcm inclusive.

2. The fixing apparatus of claim 1, wherein a total of a thickness of the fixing belt and a thickness of the elastic layer of the fixing roller is in a range of 4 mm to 8 mm inclusive.

3. The fixing apparatus of claim 1, wherein the base material layer of the fixing belt is formed from polyimide.

4. An image formation apparatus comprising:

a fixing apparatus including a fixing roller including an elastic layer, a heating roller including a heat source, the heating roller being formed by sequentially layering an elastic layer and a mold release layer on an outer circumferential face of a shaft, a fixing belt wound around the fixing roller and the heating roller, the fixing belt being formed by sequentially layering an elastic layer and a mold release layer on an endless belt type base material layer formed from heat-resistant resin, and a pressurizing roller that is pressed to the fixing roller via the fixing belt, wherein volume resistivity of the base material layer of the fixing belt is in a range of $10^{10}$ Ωcm to $10^{17}$ Ωcm inclusive, volume resistivity of the elastic layer of the fixing belt is in a range of $10^{12}$ Ωcm to $10^{16}$ Ωcm inclusive, volume resistivity of the elastic layer of the fixing roller is in a range of $10^{12}$ Ωcm to $10^{16}$ Ωcm inclusive, and volume resistivity of the elastic layer of the pressurizing roller is in a range of $10^3$ Ωcm to $10^8$ Ωcm inclusive.

* * * * *